US005979434A

United States Patent [19]

Bilanzich

[11] Patent Number: 5,979,434

[45] Date of Patent: Nov. 9, 1999

[54] CAMPER'S WIND BLOCK AND HEAT REFLECTOR

[75] Inventor: Robert Bilanzich, Sandy, Utah

[73] Assignee: Metal-Tech Design, LLC, Sandy, Utah

[21] Appl. No.: 09/041,916

[22] Filed: Mar. 13, 1998

[51] Int. Cl.[6] ..... A61F 7/00

[52] U.S. Cl. ..... 126/204; 126/552; 359/817; 135/87

[58] Field of Search ..... 126/29, 9 R, 274, 126/204, 201, 544, 547, 552, 553, 687, 684, 569; 40/789, 539, 571, 788, 610, 903; 160/352, 135, 351; 135/900, 901, 87; 359/553, 817; 256/25, 26; 607/95; 229/108.1, 117.01; 297/184.1, 184.14; 446/109, 487, 478; 220/6, 7; 206/45.21, 45.25, 45.18

[56] References Cited

U.S. PATENT DOCUMENTS

| | | | |
|---|---|---|---|
| 1,714,550 | 5/1929 | Dreher . | |
| 2,591,786 | 4/1952 | Cronheim . | |
| 3,038,463 | 6/1962 | Daymon . | |
| 3,627,272 | 12/1971 | Friedberg . | |
| 3,994,275 | 11/1976 | Williams | 126/274 |
| 4,329,978 | 5/1982 | Wormser et al. . | |
| 4,958,652 | 9/1990 | Maya | 135/900 |
| 5,263,468 | 11/1993 | Powell | 126/204 |
| 5,375,016 | 12/1994 | Hongo . | |
| 5,562,520 | 10/1996 | Pridonoff et al. | 446/148 |
| 5,623,919 | 4/1997 | Kelly | 126/204 |

FOREIGN PATENT DOCUMENTS 2 044 914 10/1980 United Kingdom .

*Primary Examiner*—Carl D. Price
*Attorney, Agent, or Firm*—Thorpe, North & Western LLP

[57] ABSTRACT

A wind blocking device having a heat reflective interior for protecting a user from exposure to wind while concurrently providing heat reflection from a campfire or other associated energy source. The device includes a foldable array of panel members laterally coupled and hinged to adjacent panel members at lateral points of attachment. The array of panels may accordingly be unfolded into a vertical panel array having an interior containment surface of generally concave configuration. An opposing, generally convex exterior wind blocking surface of the array of panels shields the user from wind chill and loss of heat by radiation. A plurality of ground support panels are coupled to a base edge of the panel array with hinge means for enabling the ground support panels to be extended at right angles to provide a stable support platform to maintain the array of panels in an assembled, vertical orientation. An heat reflective surface applied to the interior containment surface operates to reflect radiant heat toward the user when oriented toward a campfire. Structural attachment means are provided for attaching the vertical panel array to a chair to be positioned between the campfire and the vertical panel array.

25 Claims, 4 Drawing Sheets

CAMPER'S WIND BLOCK AND HEAT REFLECTOR

BACKGROUND OF THE INVENTION

1. Field of the Invention

The present invention relates to a wind block or shield device useful in the outdoors to partially surround a seated individual and block wind chill from at least three sides. More particularly, the present invention pertains to an inexpensive wind shield structure which also provides reflection of heat from an adjacent camp fire.

2. Prior Art

Preserving body heat when in the outdoors is often a challenge. Typical preventative measures against cold are to dress and insulate the body with various types of clothing that capture body heat. Although this solution is certainly the most common, there are situations where campers or other outdoor enthusiasts don't wish to be burdened with bulky coats and blankets. Alternatively, thermal underclothing may not always be suitable because changes in temperature may result in excess warmth, leading to sweating and other uncomfortable body adaptations. Changing cloths or adding thermal underwear may not always be convenient, particularly in mixed company.

The inconvenience of such changing conditions are often magnified when using an open fire for warmth and rustic atmosphere. In this situation, the body absorbs heat where exposed to the fire, but radiates heat where unexposed portions of the body are unprotected. This creates the common experience of being hot on one side, and cold on the other. Typical solutions have been to rotate exposure of the body at regular intervals in front of the fire; however, this experience is usually controlled by becoming too hot, then too cold, again hot, etc.

U.S. Pat. No. 5,263,468 by Powell discloses a portable screen having a reflective side which can be positioned behind the camper to reflect radiant heat from the fire. Accordingly, direct heat provides warmth to portions of the body that are oriented toward the fire, whereas reflective heat is available to nonexposed areas. The screen is extended on spring biased arms to form a concave reflecting surface around the camper and oriented toward a camp fire. A support pole couples to the arms to give the desired vertical stability, and the points of contact with the ground are anchored with spikes. Although a degree of heat reflective quality is realized, the construction is complex and difficult to assemble. Furthermore, protection as a wind shield operates only from a single side. The device must also be spiked to the ground to prevent displacement even by a slight breeze.

U.S. Pat. No. 5,623,919 by Kelly provides a second approach to reflective sheeting for use with a campfire. In this case, a flat panel is hung at one end from a top rim of a lawn chair, and is attached at an opposing side to a forward horizontal ground bar on the front legs of the chair. When suspended vertically from the chair, the panel forms a lower reflective surface that redirects heat towards a back reflective panel which redirects the energy to the seat back. This approach offers an inexpensive solution to the limited case of a lawn chair, but shares the same drawbacks as the Powell patent in that it operates with respect to a single direction. Furthermore, its warming influence is generally directed to the chair back, and not to the lower portion of the body. Neither does it have universal application to any campfire utility. Indeed, its disclosed utility is limited to a lawn chair configuration which already provides some wind block from the back of the user.

What is needed therefore is a wind shield which offers multidirectional functionality in any situation, even without a chair or other support device.

SUMMARY AND OBJECTS OF THE INVENTION

It is an object of the present invention to provide a simple reflector, wind breaker which horizontally wraps around the user at ground level, providing reflective properties along its total height, yet requires no poles for stability.

It is another object of this invention to provide such a reflector which may be used with or without a chair, yet can be stabilized on the ground without the need for spikes.

A further object of this invention is to facilitate inter-attachment of multiple reflector units to create a surrounding barrier of any desired shape.

These and other objects are realized in a wind blocking device having a heat reflective interior for protecting a user from exposure to wind while concurrently providing heat reflection from a campfire or other associated energy source. It comprises a foldable array of panel members including a primary central panel configured positioning adjacent to a back portion of a folding chair. The central panel is laterally coupled and hinged to adjacent panel members at lateral points of attachment. The array of panels may accordingly be unfolded into a vertical panel array having an interior containment surface of generally concave configuration. An opposing, generally convex exterior wind blocking surface of the array of panels shields the user from wind chill and loss of heat by radiation. A plurality of ground support panels are coupled to a base edge of the panel array with hinge means for enabling the ground support panels to be extended at right angles to provide a stable support platform to maintain the array of panels in an assembled, vertical orientation. An heat reflective surface applied to the interior containment surface operates to reflect radiant heat toward the user when oriented toward a campfire.

DETAILED DESCRIPTION OF THE PREFERRED EMBODIMENTS

Figure 1:
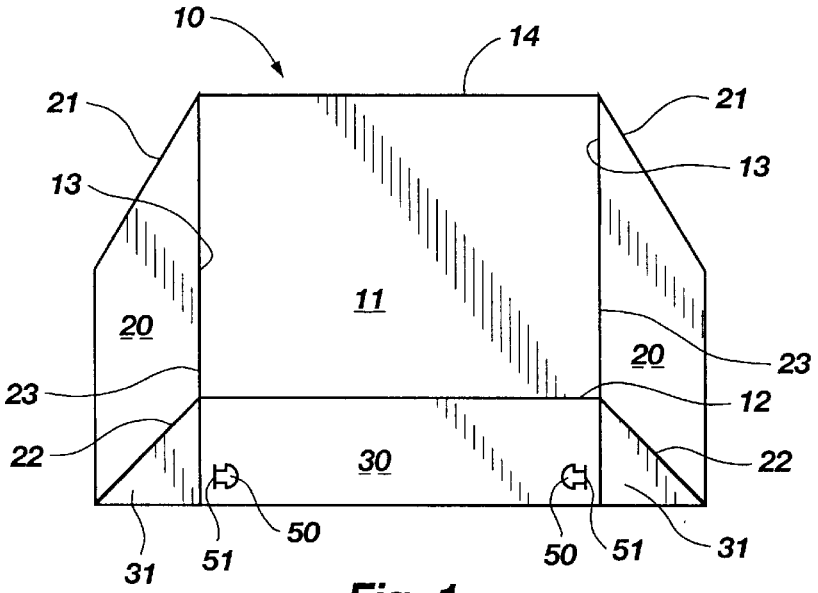
FIG. 1 is a front perspective view of a wind block device structured in accordance the principles of the present invention.
Figure 2:
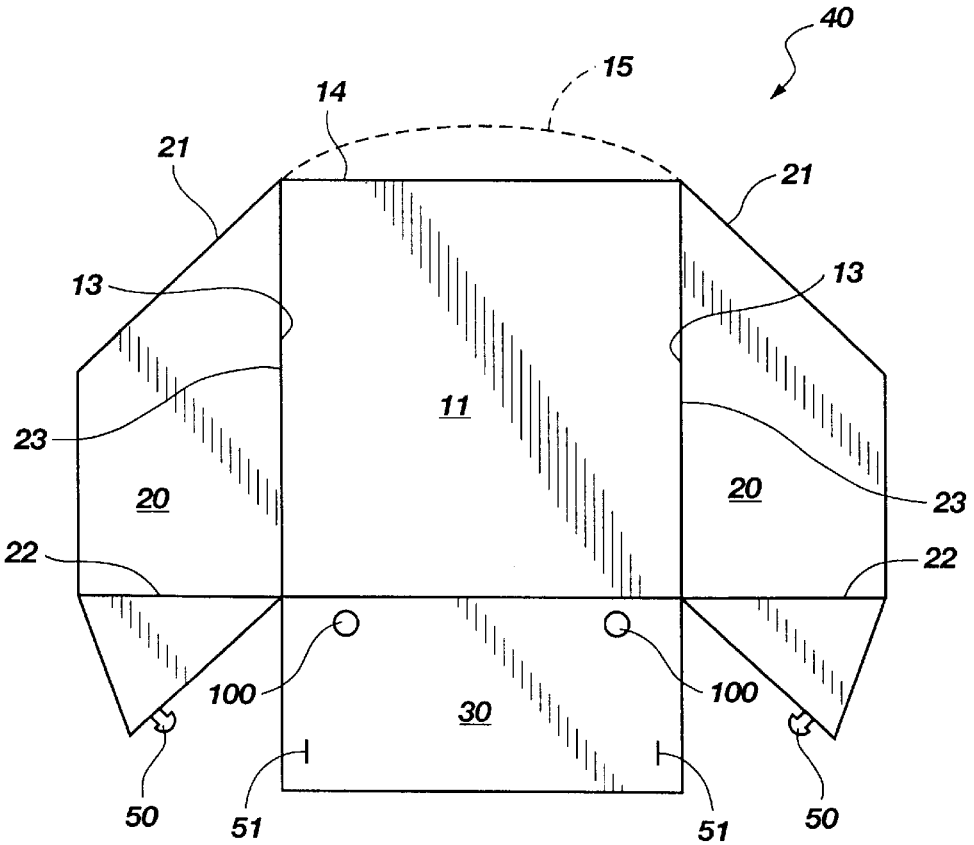
FIG. 2 is an unfolded, flattened configuration of the device shown in FIG. 1.
Figure 3:
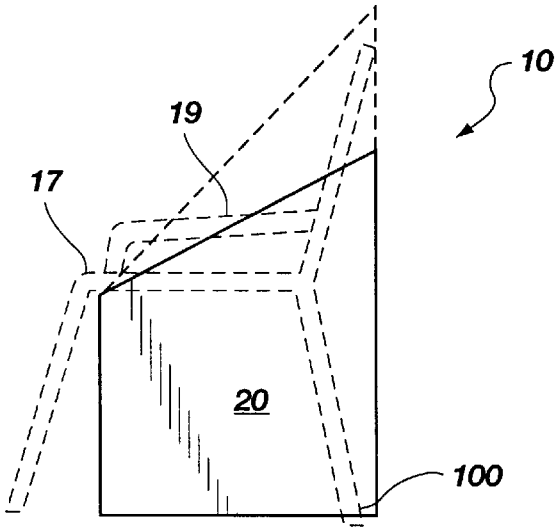
FIG. 3 represents a side view of the device of FIG. 1, including a chair shown in phantom line.
Figure 4:
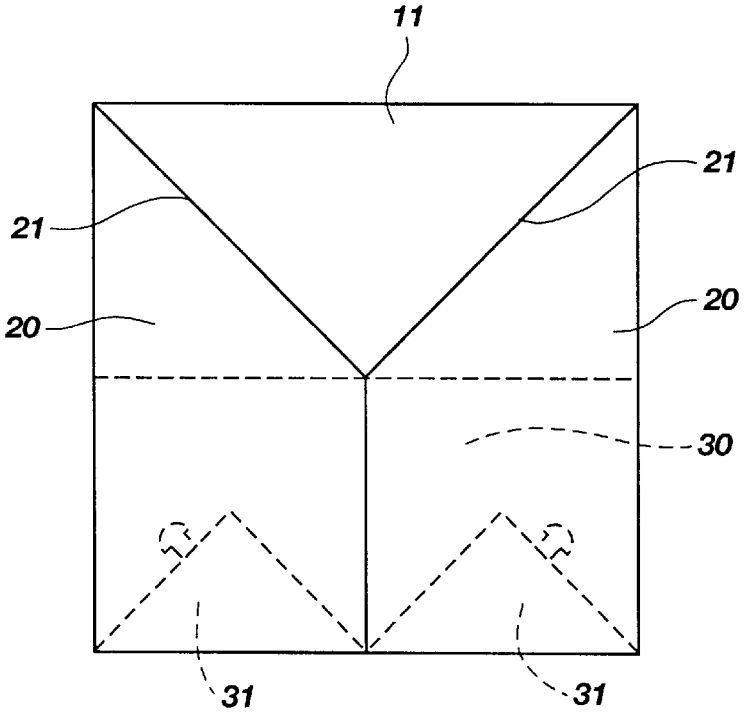
FIG. 4 depicts a device as illustrated in the preceding figures, which has been folded to a storable configuration.

FIGS. 1 and 2 show a protective shield device 10 in accordance with one embodiment of the present invention. The shield comprises an array of vertical panels, including a center panel member 11 which is configured for vertical orientation and has a base edge 12, opposing side edges 13, and a top edge 14. The center panel 11 is the primary component of the shield because is typically will have the largest width as defined between the opposing side edges, as compared to other panel components. Its position is generally proximate to the back of a chair 17 as shown in FIG. 3. With this position and its larger size, it has the greatest adaptability for attachment to the chair. Its larger size and its central place in the array of panels also makes it ideal as the center of the array when in a folded, storage configuration (FIG. 4).

The geometric configuration of the center panel is generally rectangular; however, it will be apparent that other geometries may be more aesthetically appealing, such as a rounded top edge 15. Because of the importance of being able to fold the array of panels into a small package, right angle corners will be most practical. The rectangular configuration also offers advantages for load bearing purposes. This is very significant because of the need to disperse wind loading throughout the array, as well as to support accessories which may be attached to the panels.

Side panels 20 are coupled at the opposing side edges 13 of the center panel in a hinged manner. Ideally, the panel array is an integral unit wherein a crease, score or some other hinge device operates as the referenced intermediate point of attachment. This not only maximizes the load bearing capacity of the wall structure forming the panel members, but also provides economies in the manufacture of the panel array. In essence, a single sheet of cardboard can be die cut to supply the full combination of components, including ground support panels to be identified hereafter. The fabrication process can be accomplished with a single pass of the die, including cutting the perimeter edges, tab openings and impressing score marks for hinged attachment locations between panel members. This is illustrated with the flat, unassembled configuration of the present invention depicted in FIG. 2.

As with the central panel member, the side panels may be of a variety of geometric configurations. FIGS. 1 and 2 illustrate the use of slant top edges 21 which form an acute angle with the side edge 13 of the center panel. The degree of slant may be conformed to the inclination of the shoulders of the user at the chair back 18, to a resting position for the forearms on arm rests 19 of the chair. This allows the side panels 20 to provide a lateral wind break around the user, as well as provide reflection of heat from a campfire. The side panels 20 are configured for vertical orientation and respectively have a base edge 22, and opposing side edges 23, in addition to the top edge 21. As indicated above, one of the side edges of each side panel member is hingedly coupled to the respective side edges 13 of the center panel member. The width of the side panels, as defined between the opposing edges 23, will be typically less than that of the center panel. Folding space is best economized when the side panels are approximately half the width of the center panel.

Figure 5:
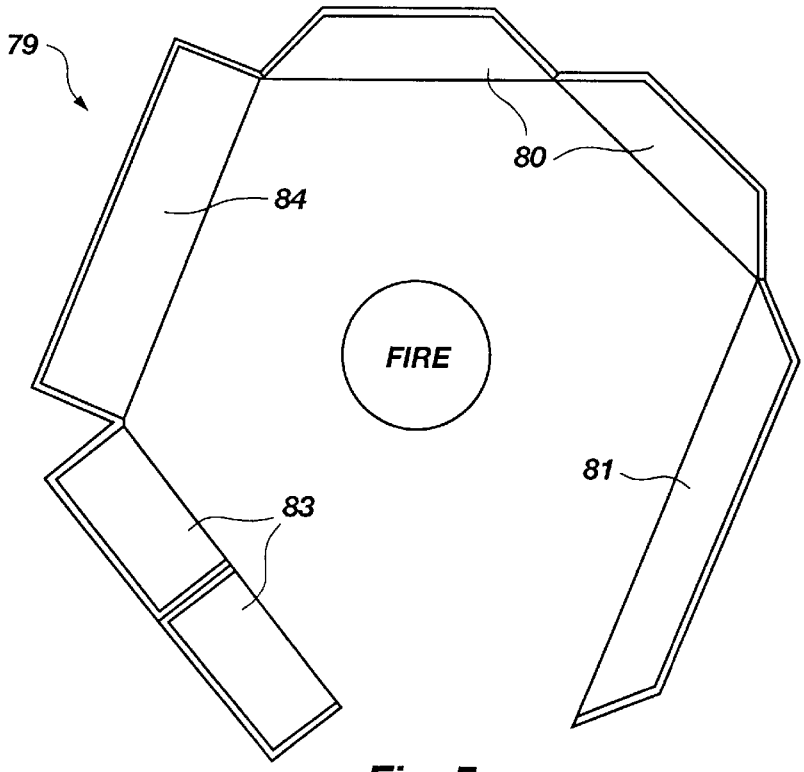
FIG. 5 is a top view of another embodiment of the present invention incorporating multiple units laterally connected to form a large enclosure.

The central and side panels form a vertical array of panels that wrap around the chair 17, thereby partially enclosing the user. It should also be noted that although three panels forms the preferred unitary structure of the panel array, additional panels may be used, depending upon the geometric curvature desired. For example, where greater curvature is preferred, an increased number of panels may be formed. Alternatively, a plurality of units or panel arrays may also be interconnected to accomplish the same result as is shown in FIG. 5. Here again, any suitable interconnecting means may be applied such as Velcro(™), snaps, hooks and loops, or tabs and slots.

The array of panel members is stabilized by a combination of ground support panel members that couple to the base edges 12 and 22 of the respective central and side panel members. These support panels provide a stiffening effect to the vertical panel members by interconnecting between them at a base portion. This not only links the respective vertical panels together in a concave or arced configuration for structural strength, but also provides a base platform for further stability. The combination of base platform and integrated vertical panel members not only greatly enhances the structural support for withstanding wind gusts, but also provides a contact platform for placing the user's weight upon the base platform. With the user's weight applied to prevent movement of the panel array, and the added strength from the integrated structure, the invention offers a significant improvement over the prior art.

The base platform of the preferred embodiment comprises a central ground panel member 30 hingedly coupled at one edge to the base edge 12 of the central panel member. The central ground panel is capable of folding forward to a ninety degree orientation with respect to the central panel member as described above. Lateral ground panel members 31 are respectively hinged at one edge to the respective base edges 22 of the first and second side panel members. These lateral ground panel members are also capable of folding forward to the ninety degree orientation with respect to the side panel members. In the preferred embodiments described, the ground panel members are integrally formed with the vertical panel members as shown in FIG. 4. The respective base edges comprise score lines on the integral sheet 40, providing for hinged folding points.

The coupling means disposed on the respective central and lateral ground panel members comprise tab 50 and slot structure 51 for interconnecting the lateral ground panel members to the central ground panel member, thus forming the stable base member for positioning on the ground. This combination of tabs and receiving slots interconnect between the respective lateral ground panels and the central ground panel. In the FIG. 3 embodiment, the tabs are positioned at sides of the of the lateral ground panel members adjacent the central ground panel member, with the slots disposed at opposing edges of the central ground panel member. Alternatively, FIG. 6 illustrates the slots 51 being positioned at sides of the of the lateral ground panel members adjacent the central ground panel member, and the tabs 50 being disposed at opposing edges of the central ground panel member.

The geometric shapes of the ground panel members will vary, depending upon the desired configuration of the ground support base. For example, by increasing the size of the side ground panels and providing a more centered attachment location on the central ground panel, the overlapping layers provide increased strength and interlocking support. Nevertheless, the illustrated embodiments depict triangular side ground panels for economizing on material and reducing weight of the total structure. The central ground panel member is preferably a rectangle; however, other configurations are possible.

The interconnecting structure of the ground panels also affects the angular relationship between the members of the vertical panel array. Generally, the first and second side panel members form angles with respect to the central panel member within a range of 30 to 60 degrees. This provides a balance of vertical stability and beneficial orientation for reflection of heat from the campfire. One of the more preferred angular values of the side panel members is approximately 45 degrees with respect to the central panel member.

Figure 6:
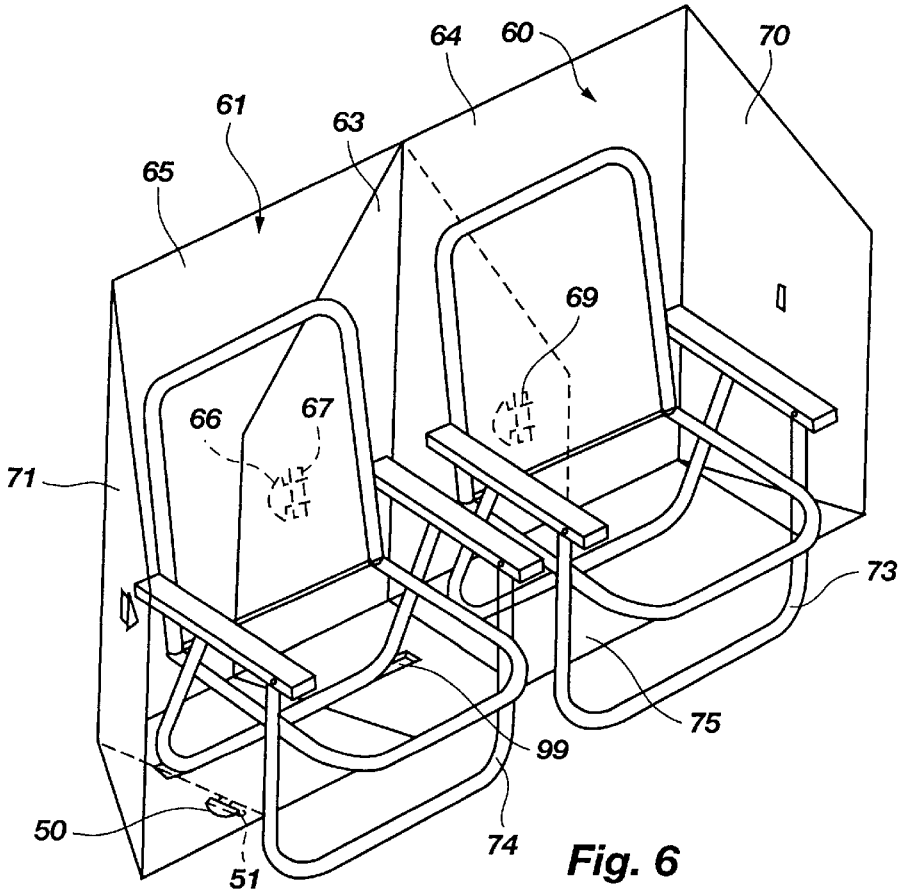
FIG. 6 illustrates an elevated, perspective view of two units interlocked to form a double seat enclosure.

FIG. 6 illustrates one of the potential variations in width of the central panel member. The embodiments of FIGS. 1 to 3 show a shield device for use by a single individual occupying one chair. Respective side panel members have a combined width approximately equal to the width of the central panel member. In this configuration, the single user receives reflective heat from the back and both sides. In FIG. 6, a two person version is illustrated. It is actually comprised of two individual units 60 and 61. The side panel 63 attached to the central panel 64 is positioned in a flat configuration against the central panel 65 of the second single unit 60. A tab 66 in an intermediate area of the side panel connects into a corresponding slot 67 in the second central panel 65. A similar slot and tab connection 69 is made by a side panel of the second unit 61 with the central panel of the first unit 60. The remaining side panels 70 and 71 are rotated to a forward orientation as shown. Two chairs 73 and 74 can be placed in this shield, with both chairs being supported on the base platform 7*d* panel members of the two units 60 and 61.

This pattern of interconnection of multiple shields can be repeated to form large enclosures 79 as shown in FIG. 5. This may include single units 80 and double units 81 as shown. The side panels may be rotated forward to 90 degrees to form a single closed box shape 83 or double box 84. This may be used for storage of supplies. It will therefore be apparent that the basic structure of a single shield can be modified with interconnecting means at various locations to enable numerous assembly configurations in a continuous arc.

These various embodiments offer numerous benefits for protection of campers or other outdoor activities. As a wind shield, the device can be oriented in a probable direction of air movement to form a barrier or wind break. In addition, a reflective material is attached at an interior surface of the respective panel members to provide reflection of radiant heat from the fire back toward the user. Even in the absence of an independent heat source, the warmth of the user's body is partially retained by the shield device. The side panels can be adjusted to any desired angle to optimize reflection of the radiant heat toward the user's location.

Numerous reflective materials are available for the present invention. Metalized Mylar(™) or other mirrored plastic sheets can be readily applied to the cardboard panels. Reflective paint may be sprayed or coated on the panels, or the panels may simply be fabricated from aluminum or other forms of reflective material. The ideal composition will provide dispersive reflection as opposed to specular reflection, to enhance uniform comfort around the user. In addition, some absorption on the reflective surface helps to create a warm temperature zone behind the user. As used herein, the term reflective is intended to comprehend all forms of reflective radiance of heat, including absorption of energy from the campfire or other energy source and subsequent radiation back to the user. These wind shield effects and reflection/absorption properties cooperate to provide a protected environment for the camper. The light weight and fold-up convenience of the present invention makes the device ideal for outdoor utility.

Figure 7:
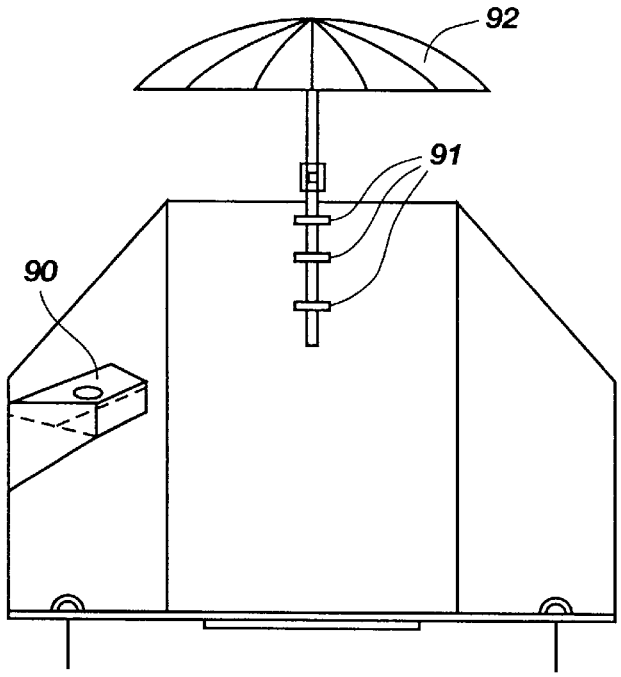
FIG. 7 is a front, plan view of an additional embodiment of the present invention.
Figure 8:
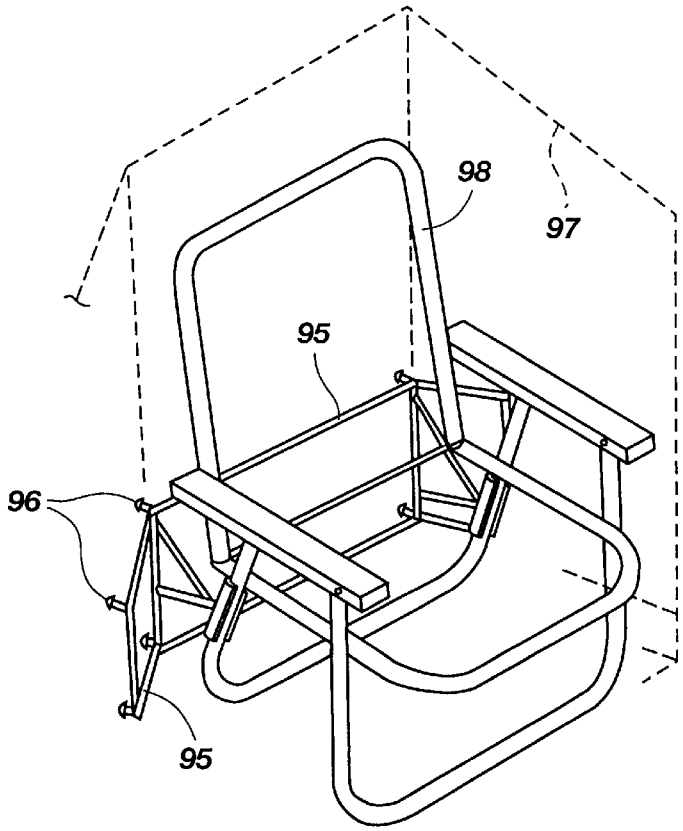
FIG. 8 is an elevated, perspective view of a chair and fastening system for use with the subject wind block (shown in phantom line).

Accessories may be attached to the vertical panel array as desired as shown in FIG. 7. For example, fold-out structures 90 may be removably inserted at the interior surface to support food items as part of an inward projecting shelf. Other support tabs 91 may be coupled to the device to support an overhead cover member 92. FIG. 8 illustrates the use of straps 95 with inserts 96 for anchoring to the panels 97 for attachment of a chair 98. Insert openings 99 (FIG. 6) and 100 (FIGS. 2 and 3) may also be formed within the ground support panels to receive portions of legs of the chair in order to integrate chair structure with the panel array. Such openings are representative of general means for interconnecting the plurality of ground support panels to a supported chair to enhance stability of the support platform with respect to the vertical panel array.

It is to be understood that the various examples illustrated above are not exhaustive, but are given to demonstrate preferred embodiments of the present invention. Accordingly, such description is not to be limiting on the scope of the invention, except as defined in the following claims.

I claim:

1. A protective shield device for use on the ground adjacent to campfires, said device comprising:

a center panel member configured for vertical orientation and having a base edge, opposing side edges defining a width, and a top edge;

first and second side panel members configured for vertical orientation and respectively having a base edge, opposing side edges defining a width which is less than the width of the center panel member, and a top edge, one of said side edges of each side panel member being hingedly coupled to one of the side edges of the center panel member;

a central ground panel member hingedly coupled at one edge to the base edge of the central panel member and being capable of folding forward to a ninety degree orientation with respect to the central panel member;

lateral ground panel members respectively hinged at one edge to one of the base edges of the first and second side panel members, said lateral ground panel members being capable of folding forward to a ninety degree orientation with respect to the side panel members; and coupling means for interconnecting the lateral ground panel members to the central ground panel member to form a stable base member for positioning on the ground.

2. A protective device as defined in claim 1, wherein the respective center, side and ground panel members comprise cardboard.

3. A protective device as defined in claim 1, wherein the respective center, side and ground panel members comprise an integral structure of one-piece construction.

4. A protective device as defined in claim 1, wherein the coupling means comprises a combination of tabs and receiving slots which interconnect between the respective lateral ground panels and the central ground panel.

5. A protective device as defined in claim 4, wherein the tabs are positioned at sides of the of the lateral ground panel members adjacent the central ground panel member, said slots being disposed at opposing edges of the central ground panel member.

6. A protective device as defined in claim 4, wherein the slots are positioned at sides of the of the lateral ground panel members adjacent the central ground panel member, said tabs being disposed at opposing edges of the central ground panel member.

7. A protective device as defined in claim 3, said cardboard including scored sections at the hinged edges of the respective-panel members.

8. A protective device as defined in claim 1, wherein the lateral ground panel members are configured with a triangular shape, said central ground panel member comprising a four sided polygon.

9. A protective device as defined in claim 1, wherein the first and second side panel members form angles with respect to the central panel member within a range of 30 to 60 degrees.

10. A protective device as defined in claim 9, wherein the angles of the side panel members are approximately 45 degrees with respect to the central panel member.

11. A protective device as defined in claim 1, wherein the respective side panel members have a combined width substantially equal to the width of the central panel member.

12. A protective device as defined in claim 1, wherein the central panel member comprises a rectangle and the respective side panel members have at least four sides including a common edge with the central panel member and a top side.

13. A protective device as defined in claim 1, wherein each of the top edges of the first and second side panel members are slanted to form an acute angle with respect one of the side edges of the first and second side panel members.

14. A protective device as defined in claim 1, further comprising coupling means for joining first and second side panel members of one protective device to first and second panels of at least one additional protective device in a continuous arc.

15. A protective device as defined in claim 1, wherein the ground support panels include at least one opening for receiving a base portion of a chair.

16. A protective device as defined in claim 1, further including a reflective material applied at an interior surface of the respective central and side panel members which are exposed to the user when in an assembled configuration.

17. A protective device as defined in claim 1, further comprising accessory panel members which couple to the interior surface and are configured to support food items as part of an inward projecting shelf.

18. A protective device as defined in claim 1, further comprising accessory panel members which couple to the device and are configured to support an overhead cover member.

19. A protective device as defined in claim 1, further comprising straps for attachment of a chair to the panel members.

20. A wind blocking device with a heat reflective interior for protecting a user from exposure to wind while concurrently providing heat reflection from a campfire or other energy source associated with a user, said device comprising:

a foldable array of panel members including a central panel of larger dimension than adjacent lateral panels and respectively having a base edge and being laterally coupled and hinged to adjacent panel members at lateral points of attachment to enable the array of panels to be unfolded into a vertical panel array having an interior containment surface of generally concave configuration and an opposing, generally convex exterior wind blocking surface;

a plurality of ground support panels coupled to the base edge of the panel array with hinge means for enabling the ground support panels to be extended at right angles to the array as part of a support platform to maintain the array of panels in an assembled, vertical orientation;

an heat reflective surface applied to the interior containment surface for reflecting radiant heat when oriented toward a campfire; and means for attaching the vertical panel array to a chair to be positioned between the campfire and the vertical panel array.

21. A device as defined in claim 20, further comprising means for interconnecting the plurality of ground support panels to enhance stability of the support platform with respect to the vertical panel array.

22. A device as defined in claim 21, wherein the means for interconnecting comprises a combination of tabs and receiving slots which interconnect between the respective ground support panels.

23. A device as defined in claim 21, wherein the respective array of panels and attached ground support panels comprise cardboard.

24. A device as defined in claim 23, wherein the respective array of panels and the ground support panels comprise a single sheet of cardboard which is scored at the points of attachment to for lateral coupling to the other adjacent panel members.

25. A protective shield device for use on the ground adjacent to campfires, said device comprising:

a center panel member configured for vertical orientation and having a base edge, opposing side edges, and a top edge;

first and second side panel members configured for vertical orientation and respectively having a base edge, opposing side edges, and a top edge, one of said side edges of each side panel member being coupled to one of the side edges of the center panel member, each of the top edges of the first and second side panel members being slanted to form an acute angle with respect one of the side edges of the first and second side panel members;

a central ground panel member coupled at one edge to the base edge of the central panel member;

lateral ground panel members coupled at one edge to one of the base edges of the first and second side panel members and coupled at another edge to the central ground panel member.

* * * * *